US006880207B2

(12) United States Patent
Cherif et al.

(10) Patent No.: US 6,880,207 B2
(45) Date of Patent: Apr. 19, 2005

(54) METHOD AND DEVICE TO EVALUATE SIGNALS OF A SENSOR TO MONITOR A TEXTILE MACHINE

(75) Inventors: Chokri Cherif, Ingolstadt (DE); Michael Ueding, Ingolstadt (DE)

(73) Assignee: Rieter Ingolstadt Spinneremaschbau AG, Ingolstadt (DE)

( * ) Notice: Subject to any disclaimer, the term of this patent is extended or adjusted under 35 U.S.C. 154(b) by 0 days.

(21) Appl. No.: 10/464,056

(22) Filed: Jun. 18, 2003

(65) Prior Publication Data

US 2004/0060352 A1 Apr. 1, 2004

(30) Foreign Application Priority Data

Jun. 20, 2002 (DE) ..... 102 27 676

(51) Int. Cl.[7] ..... D01H 5/32
(52) U.S. Cl. ..... 19/238; 19/236; 19/240
(58) Field of Search ..... 19/236, 238, 239, 19/240, 258, 98, 105, 300; 57/412; 700/130, 142; 702/170

(56) References Cited

U.S. PATENT DOCUMENTS 5,796,220 A * 8/1998 Clapp et al. ..... 318/51
6,286,188 B1 * 9/2001 Muller et al. ..... 19/239
6,581,248 B1 * 6/2003 Muller et al. ..... 19/239
6,640,392 B1 * 11/2003 Cherif et al. ..... 19/236

FOREIGN PATENT DOCUMENTS

DE 4039647 A1 6/1992
DE 4415004 A1 11/1994
DE 10140645 A1 3/2002
DE 10044402 A1 4/2002
DE 10162314 A1 9/2002

OTHER PUBLICATIONS

Book Excerpt—*Sensortechnik,* Hans–Rolf Tränker, Springer–Verlag, 1998, pp. 1280–1295.

German Search Report, Aug. 26, 2002.

* cited by examiner

*Primary Examiner*—Gary L. Welch
(74) *Attorney, Agent, or Firm*—Dority & Manning, P.A.

(57) ABSTRACT

A method and device for the evaluation of signals of a sensor, in particular of a microwave sensor, is proposed for the detection of the thickness, mass, density and/or moisture of at least one fiber sliver moving relative to the sensor on drafting equipment. A high-frequency unit assigned to the sensor produces a number of first digital signals in digital form of the current state of the (at least one) fiber sliver. The method according to the invention is characterized in that a second digital signal, representing the current sliver thickness or sliver mass of the (at least one) fiber sliver and which is then used to control the drafting equipment and/or to judge the fiber sliver quality, is formed according to an algorithm from the first digital signals made available. In addition a suitable device for the evaluation of the signals of a sensor is proposed.

43 Claims, 6 Drawing Sheets

METHOD AND DEVICE TO EVALUATE SIGNALS OF A SENSOR TO MONITOR A TEXTILE MACHINE

FIELD OF THE INVENTION

The invention relates to a process to evaluate signals of a sensor, in particular of a microwave sensor to detect thickness, mass, density and/or moisture of at least one fiber sliver moving in relation to the sensor on drafting equipment, whereby a high-frequency device assigned to the sensor produces a number of first signals in digital form concerning the current state of the (at least one) fiber sliver, as well as to a device for the evaluation of the signals of such a sensor. In addition, the invention relates to a textile machine with such a device.

BACKGROUND OF THE INVENTION

In the textile industry, fiber slivers with a cross section consisting of a plurality of individual fibers are often measured for thickness, mass, density and/or moisture. This is necessary, e.g., in the area of drafting equipment in order to draft one or several fiber slivers to reduce the number or mass of their fibers in the cross-section of fiber slivers. It is then often the goal to produce an especially uniform fiber sliver, i.e., as much as possible, a fiber sliver with the same number of fibers or mass in the cross-section over its entire length. Drafting equipment of this type is used, for example, at the output of cards, in draw frames or spinning machines. In order to be able to level the sliver mass fluctuations of the fiber slivers, sliver sensors are provided, for example, on draw frames to measure sliver thickness or sliver mass and its fluctuations and to transmit this information to a control unit. At least one of the drafting elements of the draw frame is actuated by the control unit. In addition, an inspection is conducted frequently at the output of the drafting equipment to check whether the drafting process has taken place as desired, i.e., whether the mass of the fiber sliver has been leveled out.

To measure the sliver thickness fluctuation, mechanical scanning in particular is known. This mechanical scanning is at a disadvantage at extremely high delivery speeds of over 1,000 meters per minute, as is common in modern high-performance draw frames. Furthermore, the intensive mechanical compression required with mechanical sensors has a negative effect on the subsequent drafting process.

In addition to mechanical scanning of the sliver thickness fluctuations, scanning systems such as optical rays that penetrate the sliver thickness without contact, capacitive or pneumatic measuring methods, X-rays or similar methods have become known. These methods have however individual disadvantages that made them seem unsuited until now for continuous industrial application in the textile industry.

A microwave sensor has found to be an especially advantageous sensor to measure fiber sliver quality. The thickness, mass, density and/or moisture of one or several fiber slivers moving in relation to the sensor can be ascertained very reliably by means of microwave sensors. The sensor supplies a large number of signals per time unit, providing information on the current state of the (at least one) fiber sliver. The signals are transmitted in digital form and per time unit by the microwave sensor, or more precisely, by the microwave resonator, to a downstream high-frequency installation. In such a case, the fact that as the time-dependent signals are assigned to the proper location in the fiber sliver, a great computing expenditure is disadvantageously required because of the great quantity of data supplied. Furthermore, the assignment of the signals to the point on the (at least one) fiber sliver must take place exactly at the point in time at which it is in the drafting equipment. This is difficult to achieve by means of a microwave sensor and at reasonable cost, especially with very rapidly running fiber slivers.

Furthermore, if a microwave sensor such as is known for the measuring of moisture of cigarette paper is used in a conventional textile machine, e.g., a draw frame of model RSB-D 35 of the Rieter company, the first digital signals delivered by the output of the high-frequency device are analyzed for frequency shift and half-intensity width, and the corresponding values are converted by means of a D/A converter into analog signals, and these analog signals are then switched to the leveling computer of the draw frame which is provided at its input with an A/D converter. The digital output data of the leveling computer is then in turn converted into analog signals by means of a D/A converter, and are locked on to the analog input of the servo leveler which controls the lower input and central rollers. This expensive procedure is costly and subject to errors, because of the occurrence of the undesirable phase shift and quantization errors.

OBJECTS AND SUMMARY OF THE INVENTION

It is therefore a principal object of the present invention to create a precise and economical evaluation method and a corresponding device by which the microwave technology can be used in the evaluation of the fiber sliver state. Additional objects and advantages of the invention will be set forth in part in the following description or may be obvious from the description, or may be learned through practice of the invention.

According to the invention, the microwave sensor or its assigned high-frequency device supplies a number of first signals in digital form per time unit, from which second digital signals are formed according to a predetermined algorithm, and these indicate the current sliver thickness or sliver mass of the (at least one) fiber sliver. The first signals, representing the evolution of the resonance curve, contain information regarding phase shift and half-intensity width of the resonance signals of the microwave sensor. From these signals and based on mathematical correlations, the appertaining sliver thicknesses or sliver masses can be calculated in the form of second digital signals.

By contrast with the state of the art, no individual parameters for frequency shift and half-intensity width are thereby transmitted in analog form. Instead, a second digital signal indicating the current sliver mass or sliver thickness is transmitted. These second digital signals are subsequently used to level the drafting equipment and/or to judge the fiber sliver quality at the inlet or outlet of the drafting equipment. Hereby, the second digital signals are used in an especially preferred embodiment without interim D/A conversion to calculate leveling values, designated as third signals in this terminology, to adjust the controllable drafting equipment. This calculation can be made for reasons of cost with the same processors that also clocks the high-frequency device and/or produces the second digital signals. In an alternative embodiment, a separate processor is used to produce the third digital signals.

The term "second digital signals" (for values of sliver thickness or sliver mass) and "third digital signals"for leveling values must of course be understood in the sense that digital intermediate signals can be produced between the first and the second or the second and the third signal.

Between the first and the second digital signals as well as, preferably, between the second and the third digital signals, only a purely digital processing of the signals supplied by the sensor takes place, thus no conversion into analog signals takes place. The predetermined algorithm for conversion of the first set into the second digital signals and possibly the algorithm for conversion of the second into the third digital signals is selected depending on the fiber state analysis requirements, the speed of the passage of the fiber sliver through the sensor and the processing speed of the computers using the algorithm.

With the method according to the invention, the number of first digital signals can be reduced to a few second digital signals. In general, the number of the second signals is therefore considerably lower than the number of the first signals, e.g., 1/50 of the first signals. As a result, a smaller flow of data has to be handled by the computer's microprocessor. The evaluated second signals can thus be transmitted more rapidly to the leveling system. In addition, the fiber sliver leveling system can react with greater precision if the number of the signals to be processed is lower.

The number of data can also be reduced in case of quality monitoring at the outlet of the textile machine. It is, however, advantageous in forming the second digital signals from the first digital signals not to effect such a great reduction, or not to effect any reduction at all, but to process more information, or all of the information so that, at a scanning rate of, e.g., 10 kHz, highly precise CV value calculations and spectrograms in the short-wave wavelength range can be obtained.

With the economical utilization of only one processor to calculate the second digital signals from the data of a sensor on the inlet side on the one hand (with data reduction) and a sensor on the outlet side on the other hand (without data reduction), a relatively great computing capacity is available for quality control of the data of the sensor on the outlet side. In this manner, thick and thin spots can be detected precisely at the outlet.

The algorithm for the formation of the second signals is advantageously a function of the fiber sliver speed. This means, e.g., in case of the fiber sliver running past the sensor at a higher speed, that a greater number of second signals per time unit is needed than when the fiber sliver is produced at a lower delivery speed.

For some specific applications, it is advantageous if the algorithm for the formation of the second signals is dependent upon the material of the fiber sliver. Viscose, cotton, polyester or other materials react very differently to the drafting forces in the drafting equipment. The difference in processing the first digital signals can provide compensation regarding speed of signal processing or magnitude of the signals.

It is especially advantageous if a predetermined number of first signals are skipped while taking into account material speed, and if the signal thus selected serves as the second signal. This means that only single signals are selected from the large number of first digital signals available. This reduces the number of signals and thereby the expense for further processing. If, for instance, only every $50^{th}$ first signal is selected, the cost of further processing is correspondingly lower. With a great number of applications, this nevertheless leads to very good results and information on the state of the (at least one) fiber sliver.

In another advantageous embodiment, the mean value is formed from a predetermined number of first digital signals that represents the second digital signal. Brief fluctuations in the state of the (at least one) fiber sliver that may be disregarded for further processing or evaluation of the fiber sliver(s) are averaged in this manner and provide sufficient description of the state of the fiber sliver.

Based on the skipped first signals or on those constituting the mean value of a predetermined length of the (at least one) fiber sliver, it can be assumed that a measured value for the characterization of the fiber sliver state is produced for this predetermined length. A length from 1 to 10 mm of the (at least one) fiber sliver within which at least one state signal is to be produced has been shown to be advantageous.

A reduction of data is also possible alternatively or in addition in the transition from the second to the third digital signals. The above explanations for the transition from the first digital signals to second digital signals can be applied to the transition from the second digital signals to the third digital signals.

In suitably designed systems that must process the second or the third signal, it may be advisable to convert the second or third digital signal into an analog signal before its further utilization. In the case of a third digital signal, it can be transmitted following analog conversion, e.g., to a servo controller that drives individual drafting rollers of the drafting equipment at varying speed via a differential motion gear. In an alternative embodiment, individual drives, located in corresponding control circuits where the leveling controls receive the signals, are provided for the drafting rolls.

Instead of being converted into an analog signal, the third signal can be further processed as a digital signal in an advantageous embodiment, preferably, with a controller having digital inputs serving to adjust at least one drafting roller. The controller can again be a servo controller in this case, or a controller for an individual drive.

In the device to evaluate signals of a sensor according to the invention, its resonator is assigned the mentioned high-frequency equipment for the production of a first digital signal from high-frequency signals of the microwave sensor. A microwave card in particular represents such a high-frequency device. In addition, the device according to the invention is provided with a processor unit for the production of the second and possibly the third digital signal, whereby the second digital signal represents the current sliver thickness or sliver mass. The sensor can be located at the inlet and/or at the outlet of the drafting equipment. If it is located at the inlet of the drafting equipment, it serves in particular for the measuring of the (at least one) entering fiber sliver and for the control of the speed of drafting rollers of the drafting equipment. At the outlet, the sensor is used to check the quality of the drafted fiber sliver. In addition, the signal can be used to control the drafting equipment.

If the high-frequency device is located in immediate proximity of the sensor, it is possible to use an especially short cable connection between the sensor and the high-frequency device. The cable transmitting the high-frequency signals acts as an antenna and could corrupt the signals if it is too long. This would affect the precision of fiber sliver measuring. Since modern drafting equipment functions with great precision, this would lead to unreliable measuring results, in particular on the high-precision leveling draw frames. In case of an outlet sensor, the immediate proximity of the sensor and the high-frequency device provides, furthermore, considerable advantages regarding precision of quality information on the outgoing fiber sliver when the first digital signals produced by the high-frequency device are processed into second digital signals without any data reduction.

It has been shown to be especially advantageous to keep the distance between the high-frequency device and the sensor, in particular the cable length between high-frequency device and sensor as short as possible, but not longer than 1.5 m. With the shorter the cable, the analog microwave resonance signals can be transmitted to the high-frequency device more precisely and with less transmission errors, thus producing a correspondingly precise measurement of the fiber sliver.

It is especially advantageous if the high-frequency devices and/or the processor units are connected to each other via communication lines for inlet and outlet sensor. The respective results of the evaluation of the fiber sliver states upstream of the drafting equipment and downstream of the drafting equipment can be compared and, if necessary, can be corrected. This also provides the possibility of forming a closed control circuit in order to achieve precise leveling of the fiber sliver.

It is especially economical if the high-frequency devices and/or processor units for inlet and outlet sensor are combined into one component. Since the resonators of the microwave sensors, contrary to conventional sensors, can be located very close to the drafting equipment, it is possible to use correspondingly short cable lengths, so that no interference signals take effect or are produced. For this reason, it is possible to combine the high-frequency devices and the processor units of the inlet and outlet sensors into one component. Reaction speeds based on processing times and production costs are thereby influenced favorably.

By using a correspondingly advanced technology, it is also possible, and in individual cases advantageous, if one single high-frequency device or one single processor unit is used for both the inlet and outlet sensors. If the high-frequency device and the processor unit are designed so that they are able to process the input signals with sufficient speed, it may suffice to use only one device and unit that would serve the inlet sensor as well as the outlet sensor. With a rational division of the computing and memory capacity for the data of the inlet sensor on the one hand and the outlet sensor on the other hand, the costs of additional high-frequency devices and processor units can thus be saved.

An efficient division of the memory and computing capacity is also advisable in case that one processor unit is assigned to the production of the second as well as of the third signals (as well as, if necessary, the clocking of the high-frequency device) originating in the signals of an inlet sensor. If, for example, only every fifth signal of the first digital signals is produced to produce the second digital signal, as a rule sufficient computing capacity is left to calculate the third digital signals, i.e., the leveling values.

The inlet sensor serves advantageously to produce signals used for the control of the drafting equipment. The outlet sensor serves in general to produce signals for quality monitoring of the drafted fiber sliver. These signals can be used in addition to control the drafting equipment.

The digital data transfer is advantageously realized at least in part by means of bus systems, e.g., by means of CAN bus connections.

Additional advantages of the invention are described through the following examples of embodiments.

DETAILED DESCRIPTION

Reference will now be made in detail to the presently preferred embodiments of the invention, one or more examples of which are shown in the figures. Each example is provided to explain the invention, and not as a limitation of the invention. In fact, features illustrated or described as part of one embodiment can be used with another embodiment to yield still a further embodiment. It is intended that the present invention cover such modifications and variations.

Figure 1:
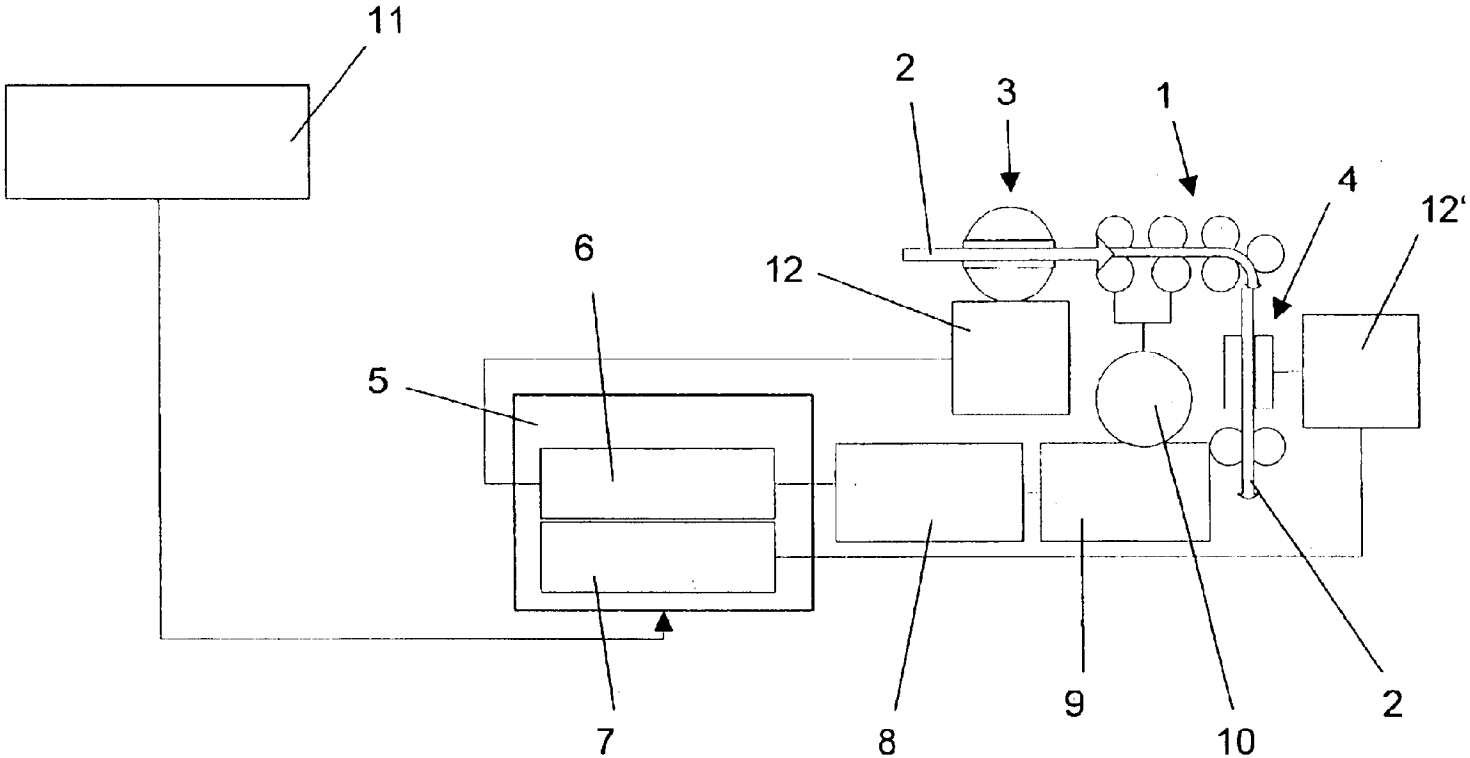
FIG. 1 shows a simplified block diagram of drafting equipment with microwave sensors.

FIG. 1 shows a simplified block diagram of drafting equipment 1 with microwave sensors. A fiber sliver 2 runs into the drafting equipment 1 in the direction of the arrow and comes out in the form of drafted fiber sliver 2'. Normally several fiber slivers 2 are at the input of the drafting equipment 1 and are united into one fiber sliver 2' by the drafting equipment at its outlet.

At the inlet of the drafting equipment 1, an inlet sensor 3 is installed. The inlet sensor 3 functions with microwave technology and determines the state of the entering fiber sliver or slivers 2. The signal produced by the processing unit 12 downstream of the inlet sensor 3 is transmitted to the controls 5 of the machine. In the block diagram shown here, the signal of a processing unit 12' downstream of the one outlet sensor 4 is also transmitted to the controls 5. The optional outlet sensor 4 is in this case located at the outlet of the drafting equipment 1. It is not necessary in every case that an inlet sensor 3 as well as an outlet sensor 4 be installed on the drafting equipment 1. Normally, the outlet sensor 4 is required only where the drafting result of the drafting equipment 1 is to be checked and evaluated or is to be used to control the drafting equipment 1.

The signal digitally processed in the processing unit 12 is transmitted from its output to the controls 5 of a leveling system 6. If the controls 5 have an analog input, the signal is either converted accordingly already in the processing unit 12 or only in the controls 5. This analog signal of the leveling system 6 is transmitted to a servo amplifier or servo regulator 8 and thereby to a connected servomotor 9. The servomotor 9 drives parts of the drafting equipment 1 via a differential motion gear 10 at varying speeds in order to level out different states of the fiber slivers 2 at the inlet of the drafting equipment 1.

The signal of the processing unit 12' of the microwave outlet sensor 4 is transmitted to a quality monitor 7 that can be integrated in a not shown embodiment also in the processing unit 12'. Here, statistical evaluations or visual displays of the obtained drafting result can be produced. Alternatively or in addition, these results can flow into the leveling system 6 or into a control of the drafting equipment 1.

The servicing and/or visualization of the desired and obtained drafting results as well as the entering of different parameters is effected via an operator interface 11 connected to the controls 5.

Figure 2:
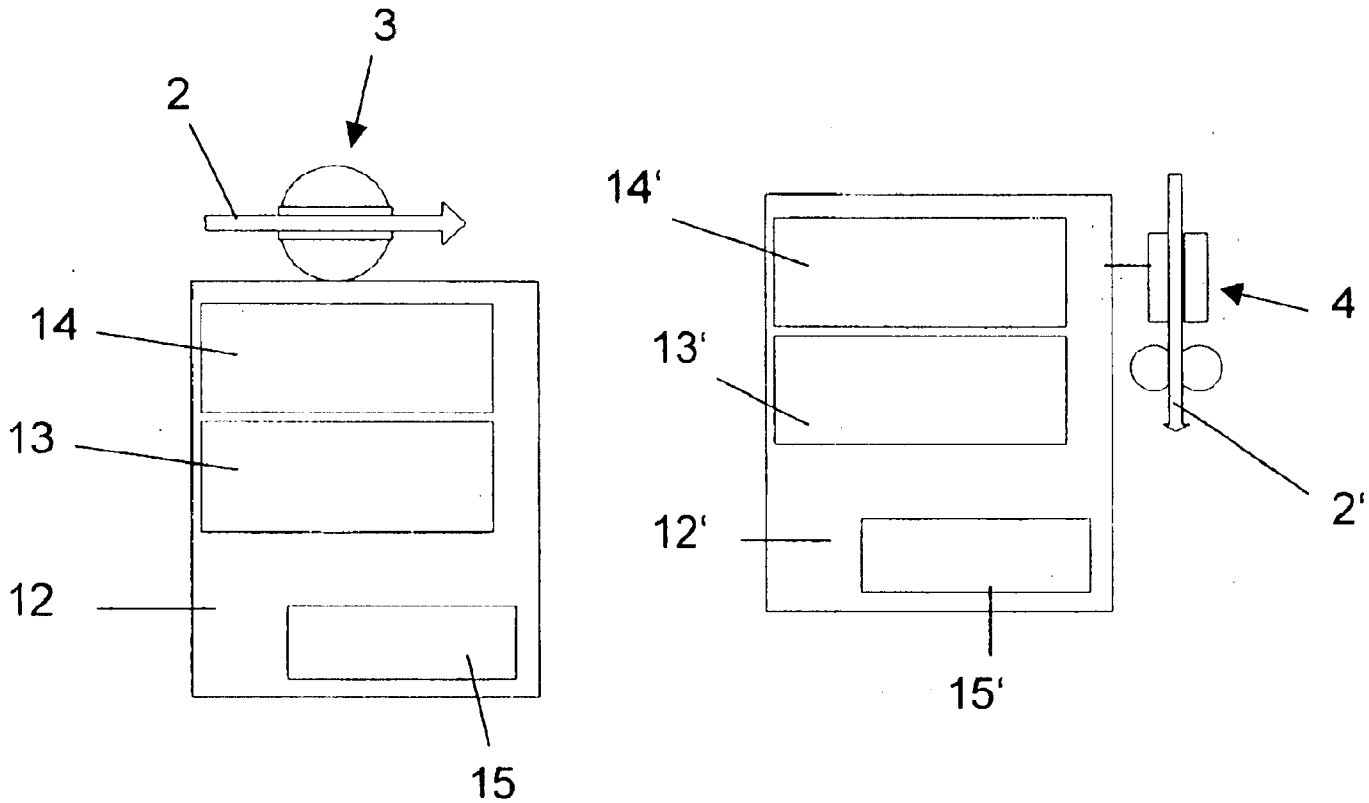
FIG. 2 shows an elementary diagram of an electronic circuit with microwave sensors at the inlet and at the outlet of drafting equipment.

FIG. 2 shows the basic diagram of an electronic circuit for an inlet sensor 3 and an outlet sensor 4 of which only the resonators are indicated in all figures. The usual equipment (microwave generators) needed for the production of microwaves, as well as coupling and uncoupling elements, circulators, etc. are not shown for the sake of clarity. A processing unit 12 is connected to the inlet sensor 3. In the processing unit 12, a high-frequency unit 13 in form of a microwave card, a processor card 14 of a microprocessor, a power supply 15 and possibly other evaluation or supply devices or interfaces are provided. The analog signals produced with the inlet sensor 3 are transmitted to the microwave card 13. The microwave card 13 functions with high-frequency technology. A short distance between the sensor 3 and the microwave card 13 is important, since possible interference signals and transmission errors can be avoided thanks to the short cable length. The first digital signals are produced by means of the microwave card 13. These first digital signals are processed in the following processor card 14 into second digital signals. These second digital signals that are produced according to a predetermined algorithm represent the current sliver thickness or sliver mass of the (at least one) fiber sliver 2. From the second digital signals, the third digital signals serving to control the drafting equipment 1 are calculated, whereby the actual regulating signals either remain in digital form or can also be converted into analog signals. A conversion into analog signals can be effected with the processor card 14 or in the leveling system 6 of FIG. 1.

The outlet sensor 4 functions with a similar design as the inlet sensor 3. The signals of the outlet sensor 4 are transmitted to the microwave card 13' which produce the first digital signals. These first digital signals are finally further processed in the processor card 14' into second digital signals in accordance with an algorithm that is predetermined here too, and may possibly deviate from the inlet sensor 3. These further processed second signals serve to monitor the quality of the delivered fiber sliver 2' and also represent the sliver thickness or sliver mass. Power supply and possibly additional inputs and outputs are indicated by box 15'.

The algorithm for the production of the second digital signals are preferably designed for data reduction of the first digital signals, whereby, e.g., individual first digital signals are skipped or averaged. Thereby, computer capacities can be saved or can be used for other tasks, e.g., the calculation of third digital signals and/or the clocking of the microwave card(s), 13. The formation of the third digital signals from the second digital signals can also make use of data reduction.

Furthermore, the algorithm can be a function of the speed of the (at least one) fiber sliver 2 and be independent of its material for the formation of the second signal and/or the third signal.

Figure 3:
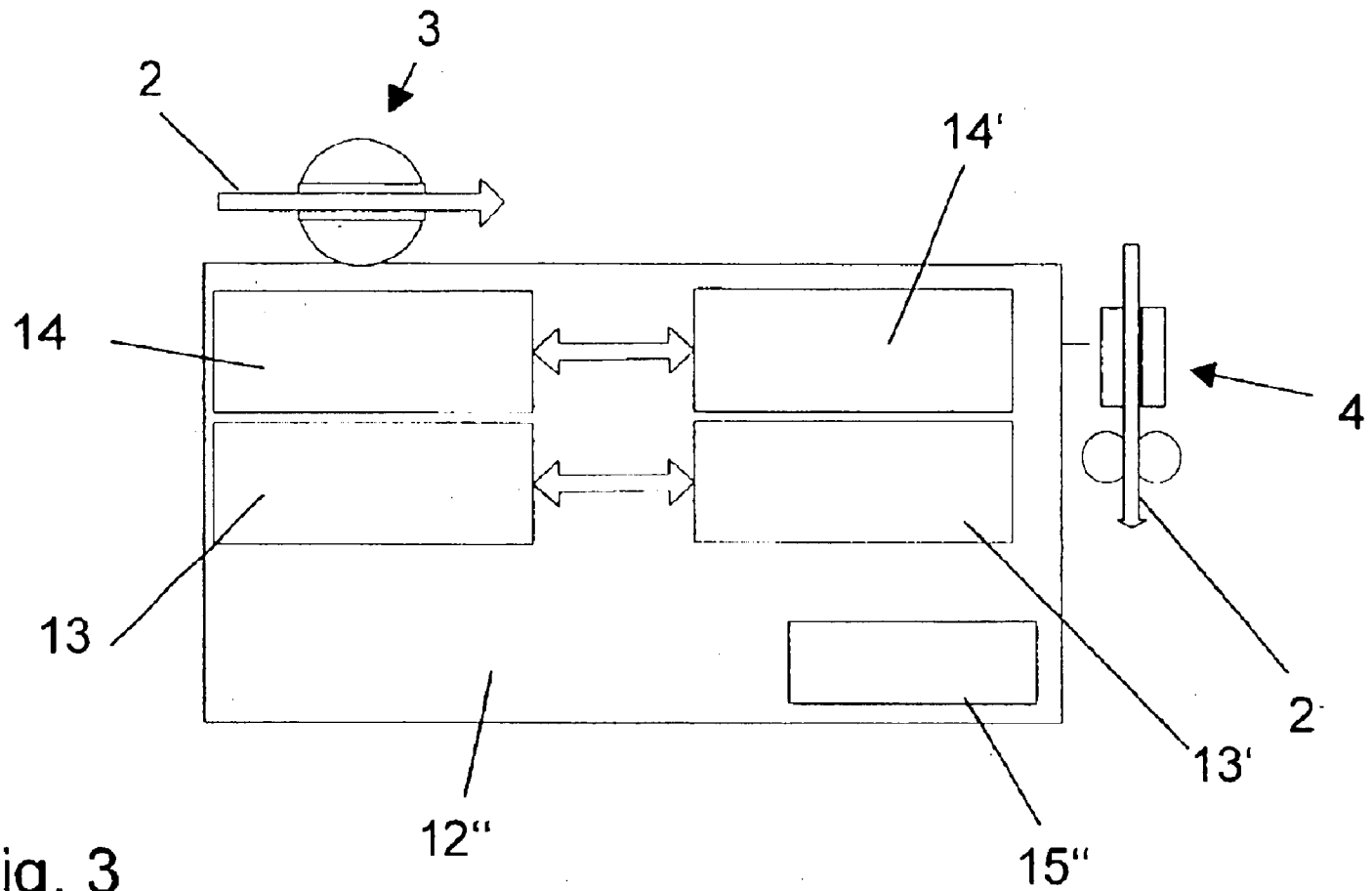
FIG. 3 shows an elementary diagram of a combined electronic circuit for an inlet sensor and an outlet sensor.

FIG. 3 shows another embodiment in the form of an elementary diagram. The evaluation units 13, 13' and 14, 14' are located in a common processing unit 12". The microwave card 13 of the inlet sensor and the microwave card 13' of the outlet sensor 4 communicate with each other and can thus exchange results and possibly use them for their own evaluation. This also applies to the processor card 14 of the inlet sensor 3 and the processor card 14' of the outlet sensor 4. These too communicate with each other and can, if necessary, use the quality data of the delivered fiber sliver 2' for the control signals. With such an interconnection of the processor cards 14, 14', it is also possible, if necessary, to make better use of their computing capacity. With this type of construction, a rapid exchange of data and, in addition, an economic structure can be achieved. In most cases, it suffices to provide a common power supply and data interface 15".

Figure 4:
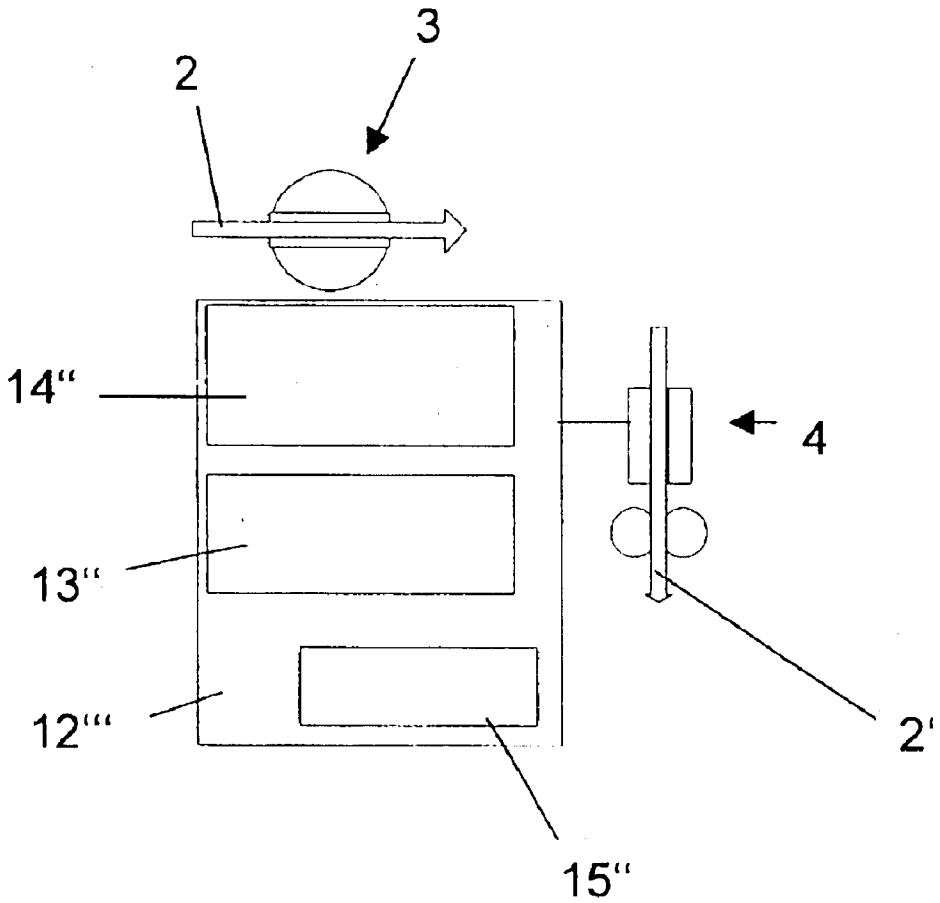
FIG. 4 shows an elementary diagram of one single processing apparatus for an inlet sensor and an outlet sensor.

FIG. 4 shows another combination in form of the processing unit 12'". With a correspondingly high-capacity technology, it suffices to use merely one microwave card 13" and one processor card 14" for the inlet sensor 3 and the outlet sensor 4. The corresponding signals of the sensors 3 and 4 can be processed in one single microwave card 13" and can be transmitted to the processor card 14". The processor card 14" can process simultaneously the signals of the microwave card 13" and convert then, on the one hand, into sliver thickness signals and then into control signals, and, on the other hand, into quality monitoring signals (therefore, also into sliver thickness signals). The evaluation of the signals of the inlet and outlet sensor 3, 4 can be effected in this manner especially rapidly. Such a solution requires, however, sufficiently capable microwave and processor cards which are advantageous mainly for very demanding applications.

Figure 5:
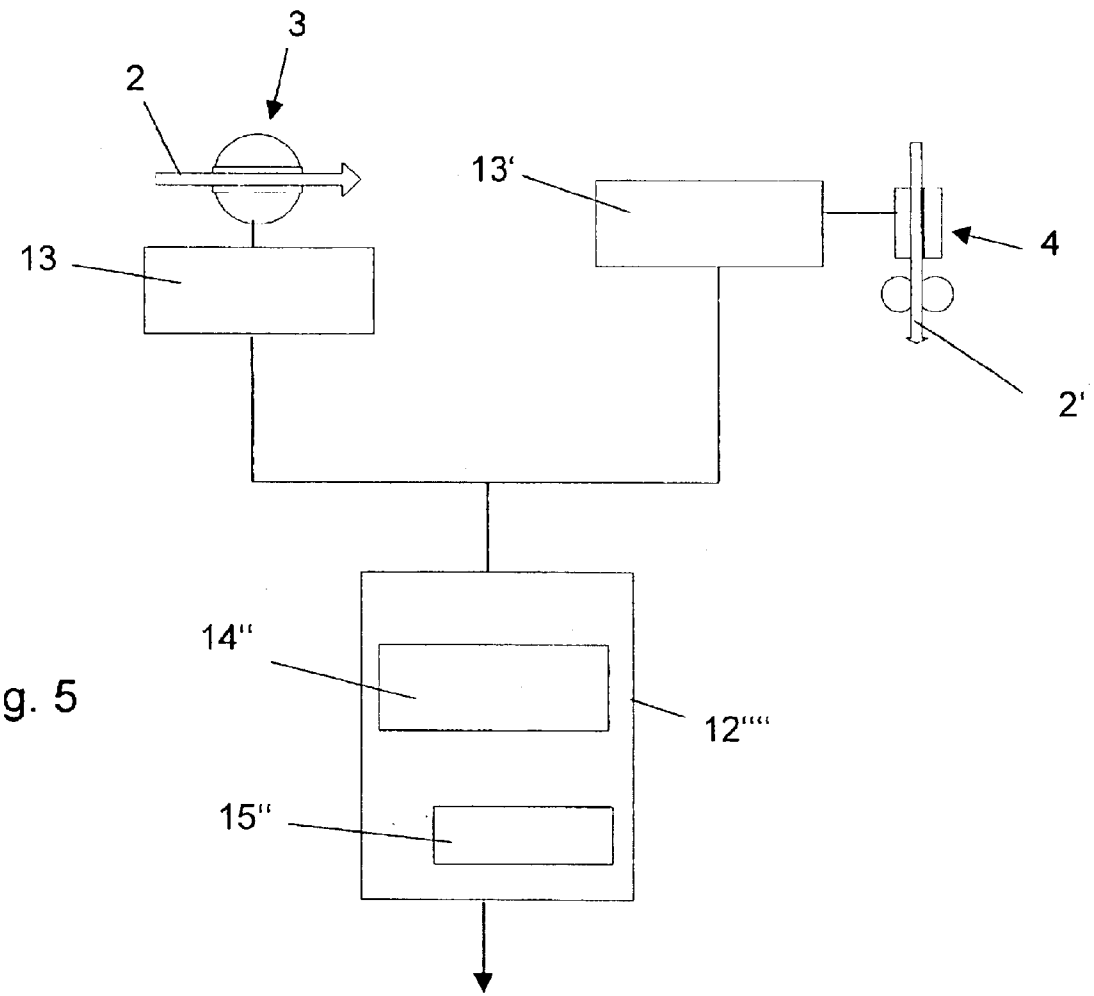
FIG. 5 shows an elementary diagram of an electronic circuit, in part separate, for an inlet sensor and an outlet sensor.

FIG. 5 shows another example of an embodiment of the design of a microwave sensor at the inlet and at the outlet, in combination with the further processing of the signals. At the inlet sensor 3 only the microwave card 13 is provided. Similarly, outlet sensor 4 is provided with only the microwave card 13'. The cable lengths needed from the sensor 3, 4 to the respective microwave card 13 or 13' can thus be kept very short. The signal produced in the microwave card 13 or 13' is transmitted to a common processor card 14" in a processing unit 12"". The common processor card 14" processes the signals thus obtained and transmits them in the form of control signals that were calculated first from sliver thickness signals, or in the form of quality monitoring signals (see arrow). With this embodiment of the invention only one high-capacity microprocessor capable of rapidly processing both signals, those from the inlet sensor 3 and those from the outlet sensor 4 is needed. It is possible to provide one single power supply 15" that supplies the sensors 3, 4 and the corresponding microwave cards 13, 13' via connection lines.

Figure 6:
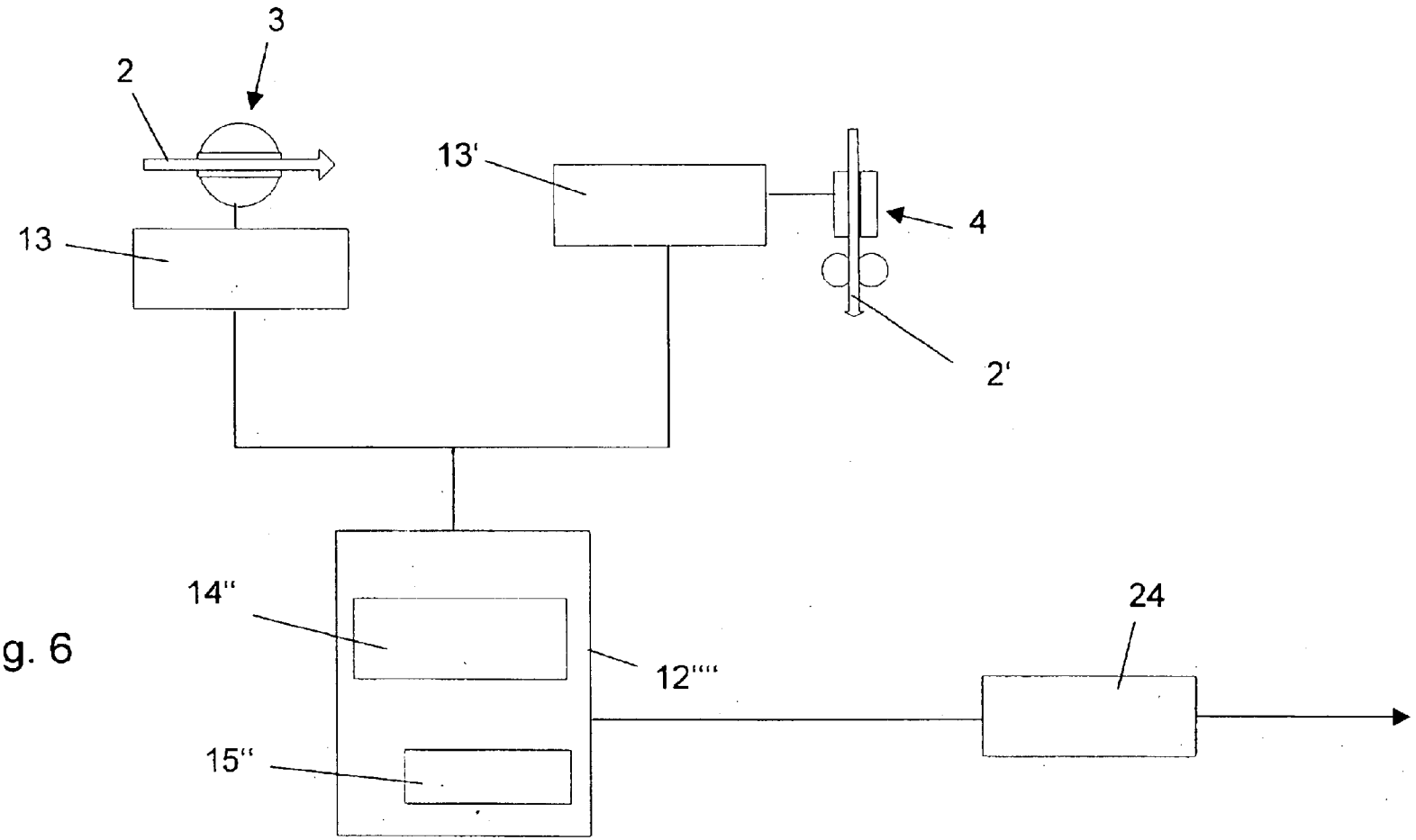
FIG. 6 shows an elementary diagram of an electronic circuit, in part separate, for an inlet sensor and an outlet sensor with an additional processor unit.

FIG. 6 shows an alternative embodiment. Here, the common processor card 14" only calculates the sliver thickness values, at least of the signals of the inlet sensor 3. These sliver thickness values represent either the second digital signals produced by the processor card 14", or they are calculated from these second digital signals. The sliver thickness values are then transmitted in digital form to a further processor unit 24 in order to calculate leveling values that represent the third digital signals in the chosen terminology, for the adjustment of the autoleveling drafting equipment (see arrow). Among these leveling values are, in particular, values regarding the starting point of leveling and/or the leveling intensity. The signals of the outlet sensor 4 are either processed exclusively in the common processor card 14" or in the processor unit 24. A display (not shown) is advantageously connected to the processor card 14" and/or the processor unit 24 in order to provide visualization to an operator and, if needed, with the added possibility, to enter machine parameter values via an operator interface (see FIG. 1).

In the embodiments shown in the figures, the clocking of the microwave card is preferably also assumed by one of the processor units or processor cards shown.

It is possible, for example, with the present invention, to effect automatic machine adjustments in a pre-operational phase, in particular to pre-set at least roughly the starting point for leveling and the leveling intensity on an autoleveling drafting equipment.

The present invention is not limited to the examples of embodiments shown. In particular, devices other than microwave sensors can be operated according to the process of the invention. Also other combinations that are not described here are covered by the subclaims of the present invention. The invention can be applied in particular with cards, draw frames and combing machines with drafting equipment. It will be appreciated by those skilled in the art that various modifications and variations can be made in the present invention without departing from the scope of the invention. It is intended that the present invention include such modifications and variations as come within the scope of the appended claims and their equivalents.

What is claimed is:

1. A method for evaluating the signals of a sensor to determine properties of fiber sliver being processed in drafting equipment on a textile machine, said method comprising the steps of:

conveying at least one fiber sliver within a range of at least one sensor connected to a high-frequency unit on the drafting equipment;

producing first digital signals per unit of time from the high-frequency unit measuring a state of the fiber sliver in digital form;

forming second digital signals according to a predetermined first algorithm using the first digital signals, the second digital signals quantifying at least one of sliver thickness or sliver mass of the fiber sliver; and using the second digital signals to perform at least one of controlling the drafting equipment or judging the fiber quality.

2. A method as in claim 1, further comprising forming third signals according to a predetermined second algorithm using the second digital signals with the third signals quantifying control values for control of the drafting equipment.

3. A method as in claim 2, wherein the third signals are formed according to the second algorithm using the second digital signals without any intervening conversion into analog signals.

4. A method as in claim 2, wherein at least one of the first algorithm or the second algorithm comprises a function of the speed of the fiber sliver.

5. A method as in claim 2, wherein at least one of the first algorithm or the second algorithm comprises a function of material of which the fiber sliver is comprised.

6. A method as in claim 2, wherein the second algorithm comprises selecting second digital signals for forming the third signals after skipping predetermined numbers of the second digital signals.

7. A method as in claim 6, wherein the selected second signals used to form the third signals correspond to a predetermined length of the fiber sliver.

8. A method in claim 7, wherein the predetermined length is between 1 mm and 10 mm.

9. A method as in claim 2, wherein the second algorithm comprises calculating mean values from predetermined numbers of second digital signals, with the mean values being used to form the third signals.

10. A method as in claim 9, wherein the mean values used to form the third signals correspond to a predetermined length of the fiber sliver.

11. A method as in claim 10, wherein the predetermined length is between 1 mm and 10 mm.

12. A method as in claim 2, wherein at least one of the second digital signals or the third signals are converted into analog signals before the at least one of the second digital signals or third signals are utilized.

13. A method as in claim 2, wherein the third signals are digital signals converted into analog signals in a controller for control of the drafting equipment.

14. A method as in claim 1, wherein the first algorithm comprises selecting first digital signals for forming the second digital signals after skipping predetermined numbers of first digital signals.

15. A method in claim 14, wherein the selected first signals used to form the second signals correspond to a predetermined length of the fiber sliver.

16. A method in claim 15, wherein the predetermined length is between 1 mm and 10 mm.

17. A method as in claim 1, wherein the first algorithm comprises calculating mean values from predetermined numbers of first digital signals, with the mean values being used to form the second digital signals.

18. A method as in claim 17, wherein the mean values used to form the second digital signals correspond to a predetermined length of the fiber sliver.

19. A method as in claim 18, wherein the predetermined length is between 1 mm and 10 mm.

20. A method as in claim 1, wherein the second digital signals are converted into analog signals before the second digital signals are utilized.

21. A method as in claim 1, wherein the at least one sensor comprises multiple sensors employed to produce signals measuring the fiber sliver at various positions in the drafting equipment.

22. A method as in claim 21, wherein a sensor is located at an inlet of the drafting equipment and a sensor is located at an outlet.

23. A method as in claim 1, wherein said at least one sensor is at least one microwave sensor.

24. A device for determining and evaluating properties of fiber sliver being processed in a textile machine, said device comprising:

drafting equipment having an inlet and an outlet for receiving at least one fiber sliver, said drafting equipment drafting said at least one fiber sliver;

at least one sensor located proximal to at least one of said inlet or said outlet of said drafting equipment, said at least one sensor gathering information about said fiber sliver;

a first high-frequency unit connected to said at least one sensor and proximal to said sensor, said first high-frequency unit producing first digital signals representing a state of said fiber sliver;

a first processor card operably connected to said first high-frequency unit for receiving said first digital signals, said first processor card producing second digital signals according to a predetermined first algorithm using said first digital signals, said second digital signals quantifying at least one of sliver thickness or sliver mass of said fiber sliver.

25. A device as in claim 24, wherein said first processor card calculates third signals from said second digital signals using a predetermined second algorithm, said third signals quantifying control values for adjustment and control of autoleveling for said drafting equipment.

26. A device as in claim 25, wherein said first processor card reduces the number of said second digital signals stored by means of said second algorithm.

27. A device as in claim 25, wherein said first processor card clocks said high-frequency unit to calculate said second digital signals and said third signals.

28. A device as in claim 24, further comprising an additional processor card connected to said processor card.

29. A device as in claim 28, wherein said additional processor calculates third signals from said second digital signals using a predetermined second algorithm, said third signals quantifying control values for adjustment and control of autoleveling for said drafting equipment.

30. A device as in claim 24, wherein said first processor card reduces the number of said first digital signals stored by means of said first algorithm.

31. A device as in claim 24, wherein the distance between said high-frequency unit and said at least one sensor is not greater than 1.5 m.

32. A device as in claim 24, wherein said first high-frequency unit and said first processor card are combined into one processing unit.

33. A device as in claim 24, wherein said at least one sensor comprises a first sensor is located proximal to said inlet of said drafting equipment for measuring at least one fiber sliver entering said drafting equipment and a second sensor located proximal to said outlet of said drafting equipment for measuring a resulting fiber sliver.

34. A device as in claim 33, wherein both said first sensor and said second sensor are connected to said first high-frequency unit.

35. A device as in claim 33, further comprising a second high-frequency unit connected to said second sensor and proximal to said second sensor, while said first high-frequency unit is connected to said first sensor and proximal to said first sensor.

36. A device as in claim 35, further comprising a second processor card connected to said second high-frequency unit, while said first processor card is connected to said first high-frequency unit.

37. A device as in claim 36, wherein said first high-frequency unit and said first processor card are connected to said second high-frequency unit and said second processor card.

38. A device as in claim 36, wherein said first and said second high-frequency units and said first and said second processor cards are combined into one processing unit.

39. A device as in claim 33, wherein said first sensor at said inlet of said drafting equipment supplies signals for adjustment and control of autoleveling for said drafting equipment and said second sensor at said outlet of said drafting equipment supplies signals for quality control of said fiber sliver.

40. A device as in claim 33, wherein said second sensor at said outlet of said drafting equipment supplies signals for adjustment and control of autoleveling for said drafting equipment.

41. A device as in claim 33, wherein both said first sensor and said second sensor supply signals for adjustment and control of autoleveling for said drafting equipment.

42. A device as in claim 24, wherein said first processor card clocks said high-frequency unit to calculate said second digital signals.

43. A device as in claim 24, wherein said first high-frequency unit comprises a microwave card.

* * * * *